US011823822B2

(12) United States Patent
Khan et al.

(10) Patent No.: US 11,823,822 B2
(45) Date of Patent: Nov. 21, 2023

(54) STRUCTURAL ARRANGEMENT FOR MOUNTING CONDUCTOR WINDING PACKAGES IN AIR CORE REACTOR

(71) Applicant: Siemens Energy Global GmbH & Co. KG, Munich (DE)

(72) Inventors: Kamran Khan, Toronto (CA); Andrew Lang, Toronto (CA)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/250,543

(22) PCT Filed: Nov. 12, 2020

(86) PCT No.: PCT/US2020/060212
§ 371 (c)(1),
(2) Date: Apr. 26, 2023

(87) PCT Pub. No.: WO2022/103395
PCT Pub. Date: May 19, 2022

(65) Prior Publication Data
US 2023/0343509 A1 Oct. 26, 2023

(51) Int. Cl.
*H01F 27/06* (2006.01)
*H01F 27/30* (2006.01)

(52) U.S. Cl.
CPC ..... *H01F 27/306* (2013.01)

(58) Field of Classification Search
CPC ..... H01F 27/06
USPC ..... 336/65, 199
See application file for complete search history.

(56) References Cited

U.S. PATENT DOCUMENTS 2,372,950 A * 4/1945 Holmberg ..... H01F 37/005 264/261
3,225,319 A * 12/1965 Trench ..... H01F 37/005 336/84 R
3,264,590 A * 8/1966 Trench ..... H01F 37/005 336/60
3,621,429 A * 11/1971 Benke ..... H01F 27/303 336/197
3,991,394 A * 11/1976 Barnwell ..... H01F 37/005 336/60
4,462,017 A * 7/1984 Knapp ..... H01F 37/005 336/205
4,538,131 A * 8/1985 Baier ..... H01F 37/005 336/197

(Continued)

FOREIGN PATENT DOCUMENTS

EP 1724793 A2 11/2006
WO 2017058565 A1 4/2017

OTHER PUBLICATIONS

PCT International Search Report and Written Opinion of International Searching Authority dated Aug. 12, 2021 corresponding to PCT International Application No. PCT/US2020/060212 filed Nov. 12, 2020.

*Primary Examiner* — Ronald Hinson
(74) *Attorney, Agent, or Firm* — Enrique J. Mora

(57) ABSTRACT

An improved structural arrangement for mounting winding packages in the air core reactor is provided. Disclosed embodiments make use of structural properties, such as hoop tensile properties, of a filament roving 130 that may be arranged to surround structural features (e.g., inclined surfaces 108) formed in a disclosed mounting plate 110.

21 Claims, 3 Drawing Sheets

(56) References Cited

U.S. PATENT DOCUMENTS

| | | | | | |
|---|---|---|---|---|---|
| 4,874,916 | A * | 10/1989 | Burke | H05B 6/22 | 336/62 |
| 5,027,099 | A * | 6/1991 | Burke | H01F 30/08 | 336/60 |
| 5,202,584 | A * | 4/1993 | Burke | H01F 27/085 | 333/175 |
| 5,225,802 | A | 7/1993 | Dudley et al. | | |
| 2014/0327509 | A1* | 11/2014 | Lacerda | H01F 37/005 | 336/185 |
| 2015/0170818 | A1* | 6/2015 | Sharp | H01F 27/085 | 336/60 |
| 2016/0005529 | A1 | 1/2016 | Haslehner | | |
| 2016/0104568 | A1* | 4/2016 | Best | G10K 11/002 | 336/199 |
| 2017/0316871 | A1 | 11/2017 | Kahn | | |

* cited by examiner

STRUCTURAL ARRANGEMENT FOR MOUNTING CONDUCTOR WINDING PACKAGES IN AIR CORE REACTOR

BACKGROUND

Disclosed embodiments relate generally to the field of electrical apparatuses, and, more particularly, to air core reactors.

BRIEF DESCRIPTION

A disclosed embodiment is directed to an air core reactor including a winding package positioned to extend along a central axis from a first reactor end to a second reactor end that is opposite the first reactor end. A spider arm extends in a direction radially away from the central axis to a spider end. The spider arm is located at the first reactor end and is coupled to the winding package. A mounting plate is coupled to the spider arm. The mounting plate has a height that extends between a first plate edge and a second plate edge. The mounting plate includes an outward plate portion having a ramped surface that extends along a width of the mounting plate from a plate location between the first plate edge and the second plate edge to the second plate edge. The ramped surface defines an oblique angle relative to a plane orthogonal to the height and the width of the mounting plate.

Another disclosed embodiment is directed to a method of operating an air core reactor having a winding package positioned to extend along a central axis from a first reactor end to a second reactor end, and a spider arm that extends in a direction radially away from the central axis to a spider end. The method includes coupling a mounting plate to the spider arm. The mounting plate has a height that extends between a first plate edge and a second plate edge. The mounting plate includes an outward plate portion having a ramped surface that extends along a width of the mounting plate from a plate location between the first plate edge and the second plate edge to the second plate edge. The ramped surface defines an oblique angle relative to a surface orthogonal to the height and the width of the mounting plate. The method further includes winding a filament roving over 360 degrees about the central axis to provide circumferential support to the cylindrical winding package and surrounding the ramped surface of the mounting plate with the filament roving. In response to bending of the spider arm that develops during operation of the air core reactor, the filament roving that surrounds the ramped surface develops a hoop tension effective to restrain the bending of the spider arm.

DETAILED DESCRIPTION

Figure 1:
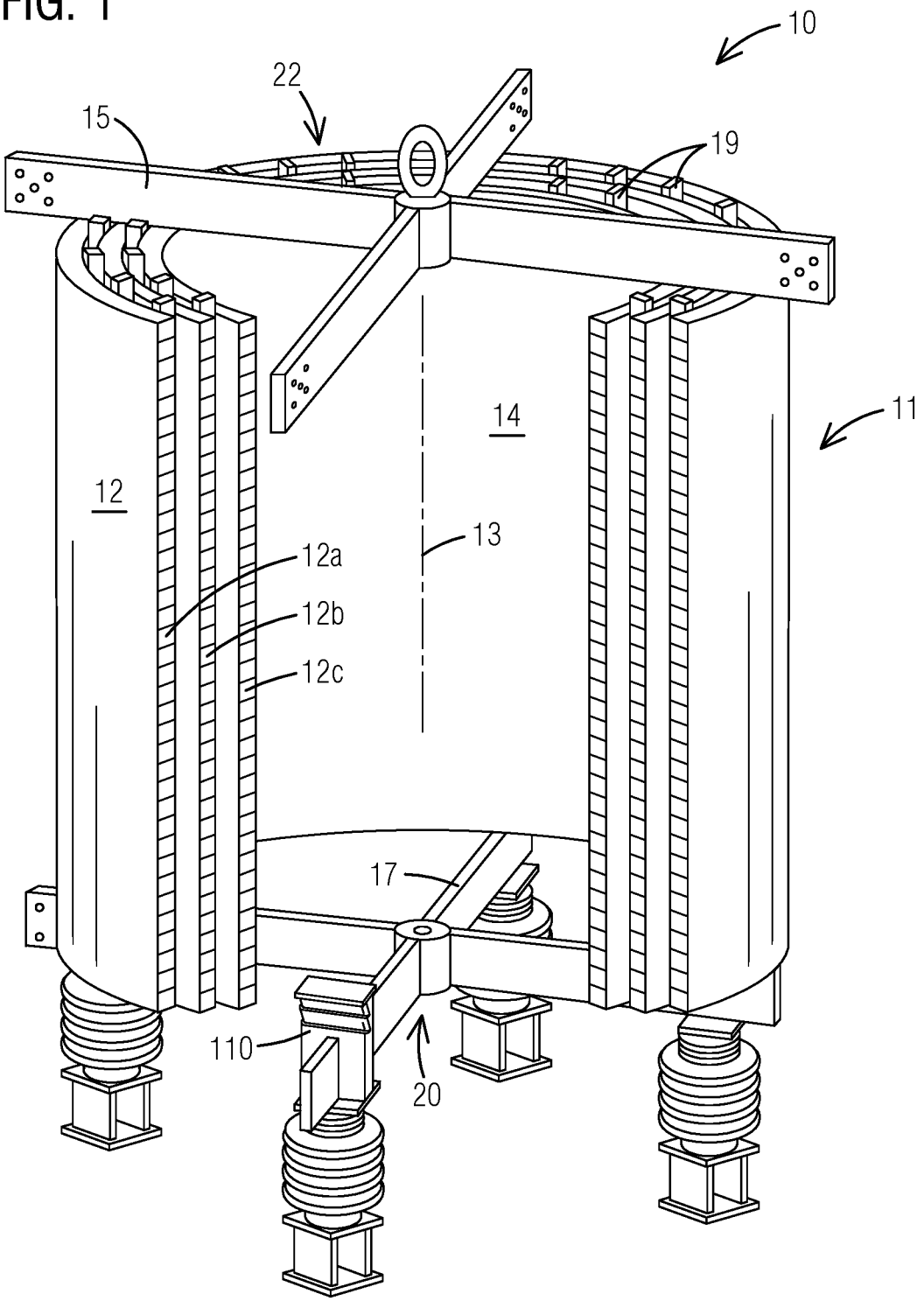
FIG. 1 is a fragmentary, cut-away view of an electrical apparatus, such as an air core reactor, that can benefit from disclosed structural arrangements for mounting conductor winding packages in the air core reactor.

FIG. 1 is a fragmentary, cut-away view of an electrical apparatus, such as an air core reactor 10, that can benefit from disclosed embodiments described in greater detail below. Disclosed embodiments involve an improved structural arrangement (including a mounting plate 110 to be described in greater detail below) for mounting winding packages in the air core reactor. The terms air core reactor, air core inductor and air core coil are often used interchangeably by those skilled in the art and refer to inductors that involve an air core in lieu of a magnetic core made of a ferromagnetic material. An inductor (reactor, or coil) is a passive electrical component that may be used to store energy available in an electromagnetic field when electric current flows through the inductor.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may.

It is noted that disclosed embodiments need not be construed as mutually exclusive embodiments, since aspects of such disclosed embodiments may be appropriately combined by one skilled in the art depending on the needs of a given application.

Air core reactor 10 includes one or more electrical devices, such as a plurality of radially-concentric, spaced-apart winding packages 12 (e.g., cylindrical winding packages) positioned about a central axis 13 that extend from a first reactor end 20 to a second reactor end 22. The cylindrical winding packages 12 may define a centrally-disposed hollow cavity 14. It will be appreciated that air core reactor designs may include fewer or substantially more winding packages than shown in FIG. 1 (e.g., ranging from one winding package to twenty or more winding packages). For simplicity of illustration, FIG. 1 illustrates just three winding packages labelled 12*a*, 12*b*, 12*c*.

Without limitation, cylindrical winding packages 12 may be positioned between an upper spider unit 15 and a lower spider unit 17, which, in certain embodiments, may function as terminals for connecting power lines and/or for interconnecting the cylindrical windings in a desired electrical configuration, such as a parallel circuit arrangement. Additionally, the spider units may constitute structural members that facilitate lifting and/or fastening to the mounting system of a given reactor, to other reactors, or both. Winding packages 12*a*, 12*b*, 12*c* may be radially separated from one another by a plurality of circumferentially spaced-apart spacers 19, which may be positioned to have a vertical orientation extending in a direction parallel to axis 13. It will be appreciated that in certain embodiments the upper spider unit may not be used.

The present inventors have recognized that certain prior mounting arrangements for winding packages in air core reactors tend to be structurally limited by mechanical stresses, such as may involve deformations (e.g., bending), that can form about any of the axes of a given spider arm during operation of the air core reactor, such as may occur during a short circuit event, a seismic event, extreme environmental temperatures, etc.

At least in view of the foregoing recognition, disclosed embodiments make use of structural properties, such as hoop tensile properties, of a filament roving 130 (FIG. 2) that may be arranged to surround structural features (e.g., inclined surfaces) formed in disclosed mounting plate 110. These structural features are designed to permit developing—e.g., in response to bending of the spider arm—a hoop tension by the filament roving, and this hoop tension is effective to restrain the bending of the spider arm that can develop during operation of the air core reactor. That is, disclosed embodiments, in a cost-effective and reliable manner, improve the bending strength (also known as flexural strength) of mounting arrangements in air core reactors.

Figure 2:
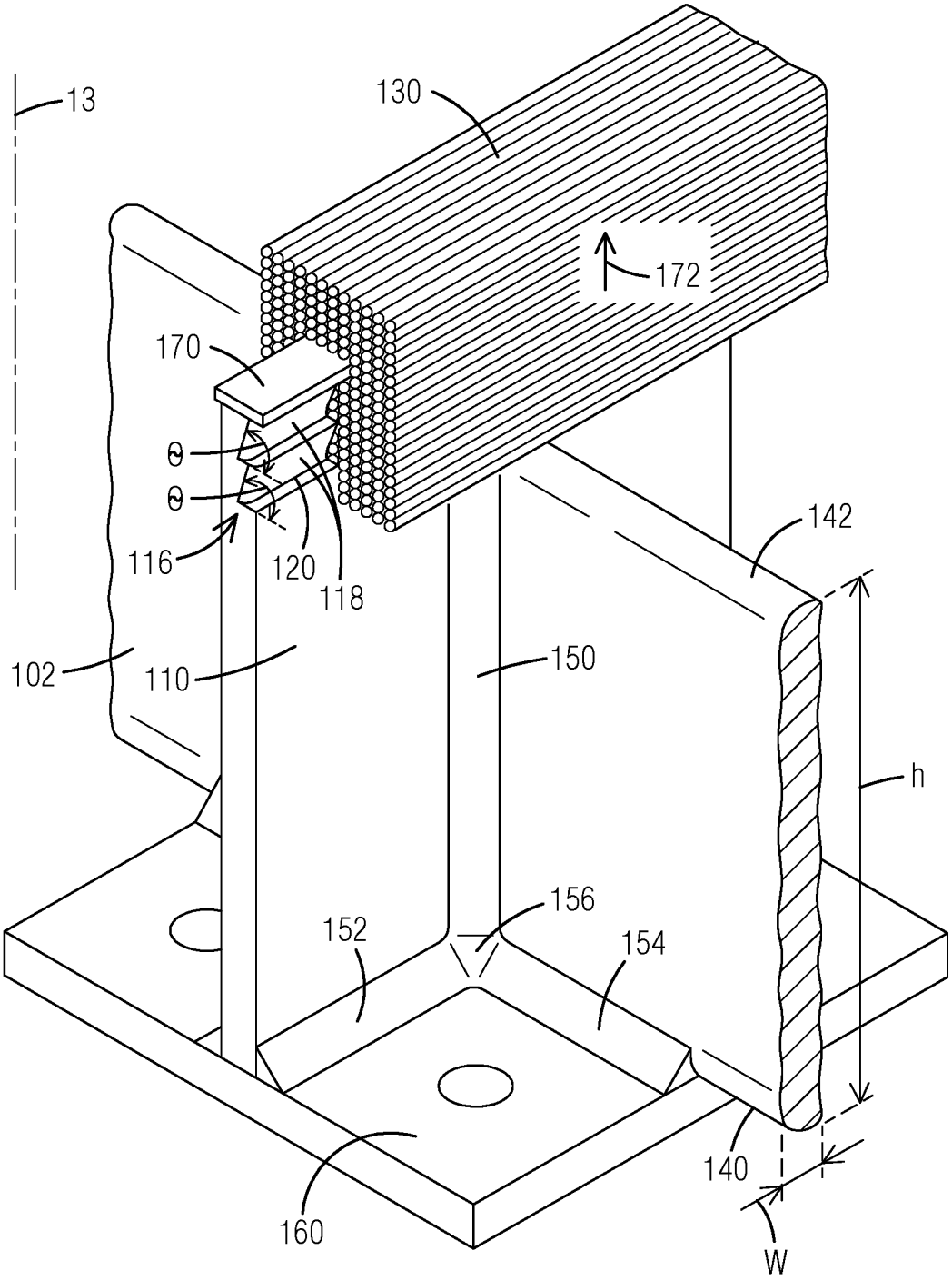
FIG. 2 is a fragmentary, isometric view of one embodiment of a disclosed mounting plate assembled with a spider arm and a filament roving.

FIG. 2 is a fragmentary, isometric view of one embodiment of disclosed mounting plate 110 assembled with a spider arm 102 and filament roving 130. In one non-limiting embodiment, spider arm 102 extends in a direction radially away from central axis 13 to a spider end and may be coupled to a winding package. Although in FIG. 1, the arms of spider units 15, 17 are illustrated as extending from central axis 13, it will be appreciated that in certain embodiments, the spider arms may be truncated. That is, the spider arms need not extend from central axis 13 but from a point located between central axis 13 and the spider end.

Without limitation, in the illustrated embodiment, mounting plate 110 is coupled to spider arm 102, which may be part of lower spider unit 17 (FIG. 1). It will be appreciated that in certain applications a further mounting plate and further filament roving could be coupled to a second spider arm that may be part of upper spider unit 15 (FIG. 1).

Figure 4:
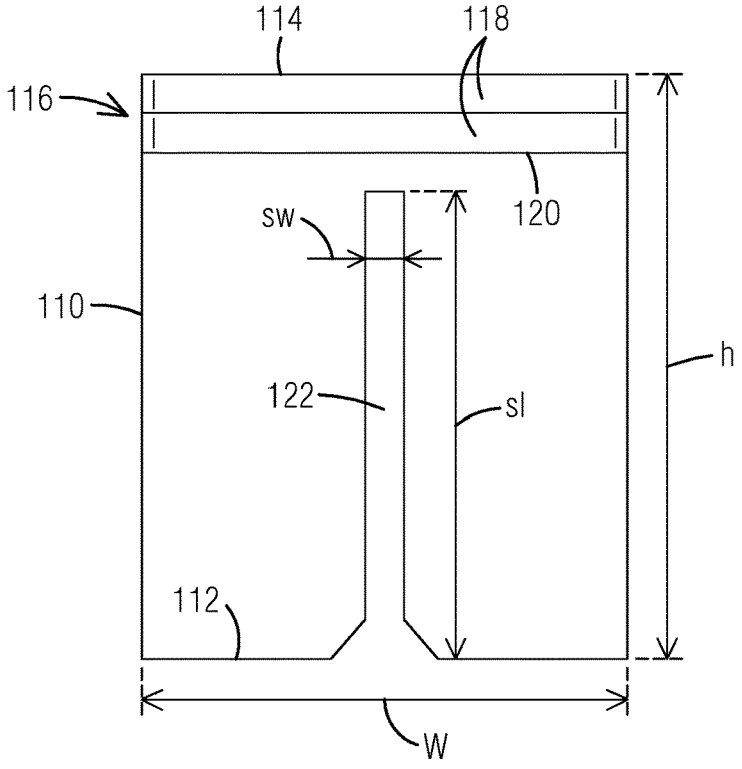
FIG. 4 is an elevational, front view of the disclosed mounting plate.
Figure 5:
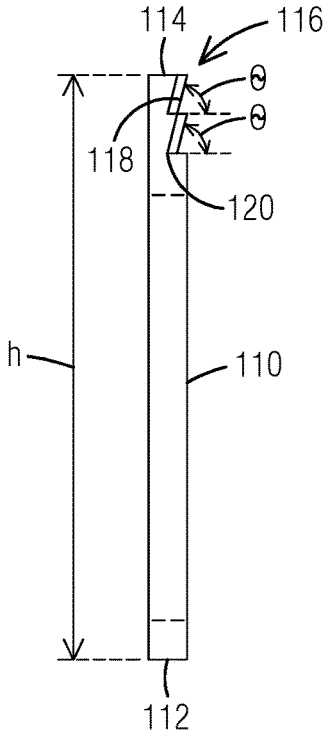
FIG. 5 is an elevational, side view of the disclosed mounting plate.

Mounting plate 110, as shown in FIGS. 4 and 5, has a height (h) that extends between a first plate edge 112 and a second plate edge 114. Mounting plate 110 includes an outward plate portion 116 having a ramped surface 118 that extends along a width (w) of the mounting plate from a plate location 120 between the first plate edge and the second plate edge to the second plate edge. In one non-limiting embodiment, the height of mounting plate 110 extends parallel to central axis 13 and the width of mounting plate 110 extends in a direction normal to central axis 13.

The ramped surface defines an oblique angle θ relative to a plane orthogonal to the height and the width of mounting plate 110. In one non-limiting embodiment, the ramped surface defines an increasing radius relative to the central axis from plate location 120 to second plate edge 114. In one non-limiting embodiment, ramped surface 118 may be formed by a plurality of inclined surfaces between plate location 120 and second plate edge 114. It will be appreciated that the respective oblique angles defined by such inclined surfaces need not be equal.

Figure 3:
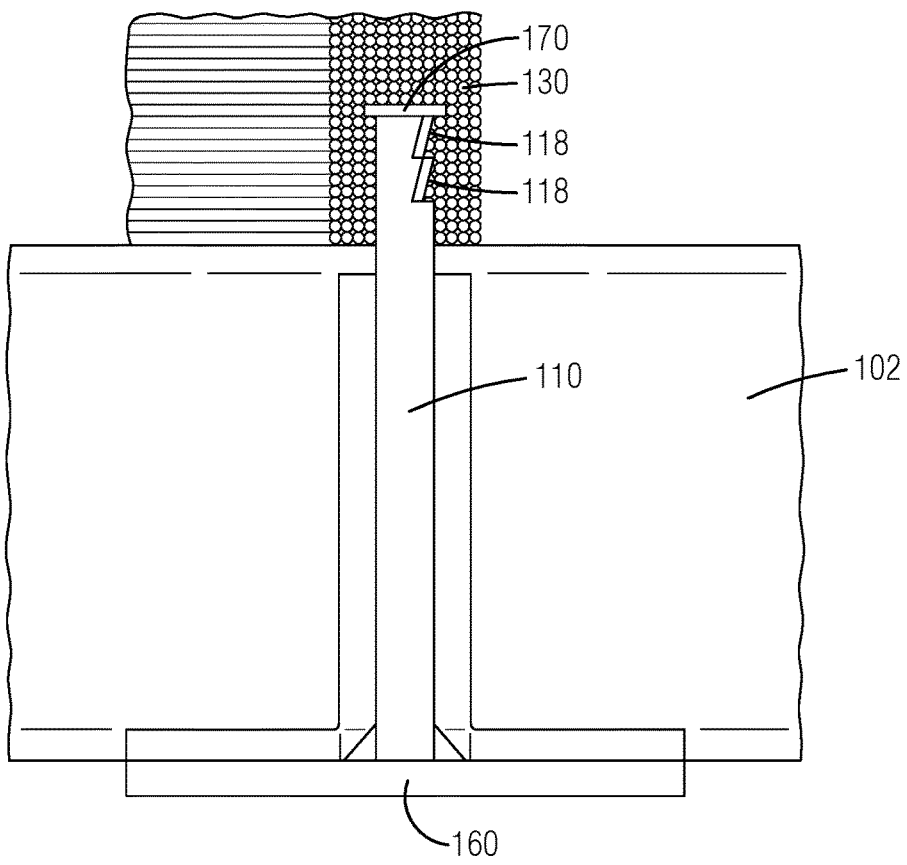
FIG. 3 is an elevational, side view of the assembly shown in FIG. 2.

In one non-limiting embodiment, filament roving 130 is wound 360 degrees about central axis 13 to provide circumferential support to an associated winding package. In one non-limiting embodiment, ramped surface 118 of the support plate is surrounded by filament roving 130. As may be appreciated in FIG. 3, the entire plate portion of mounting plate 110 that at least includes ramped surface 118 plate may be embedded in filament roving 130. That is, the entire plate portion of mounting plate 110 that at least includes ramped surface 118 is enclosed by filament roving 130 in a closed envelope.

In one non-limiting embodiment, the filament roving may be formed from a resin-impregnated fiber material, and the fiber material may be made up of at least one type of fiber, such as glass fibers, basalt fibers, aramid fibers and polyester fibers. Filament roving 130 may be applied using a "wet winding technique", where, as would be readily appreciated by those skilled in the art, the fiber material is impregnated with a curable resin, which is subsequently cured to enclose at least the portions of mounting plate 110 that include the ramped surface. It will be appreciated that pre-impregnated fibers or tapes could be used to form the filament roving.

In one non-limiting embodiment, spider arm 102 (FIG. 2) includes a planar portion having a height h that extends parallel to central axis 13 to define a first spider arm edge 140 and a second spider arm edge 142, and a width w that extends in a direction normal to central axis 13 to define an edge width of spider arm 102.

In one non-limiting embodiment, mounting plate 110 has a slot 122 (FIG. 4) that extends from first plate edge 112 to define a slot length (sl) sized to receive the height of the planar portion of the spider arm and having a slot width (sw) sized to receive the width of the planar portion of spider arm 102.

In one non-limiting embodiment, a first weld joint 150 (FIG. 2) extends along the slot (e.g., along height of spider arm) to affix mounting plate 110 to spider arm 102 at a slot interface.

In one non-limiting embodiment, a support stand 160 has a planar surface arranged to support the edge width of mounting plate 110 at first plate edge 112 (FIG. 4) and first spider arm edge 140. In one non-limiting embodiment, a second weld joint 152 (FIG. 2) extends along the edge width of mounting plate 110 to affix first plate edge 112 to support stand 160. In one non-limiting embodiment, a third weld joint 154 extends along first spider arm edge 140 to affix the first spider arm edge to support stand 160.

In one non-limiting embodiment, first weld joint, 150, second weld joint 152, and third weld joint 154 intersect at a common joining point 156 of first plate edge 112, first spider arm edge 140 (FIG. 4) and the planar surface of support stand 160.

Depending on the needs of a given application, one may optionally include a dielectric strip 170 (FIGS. 2 and 3) that extends along the width of mounting plate 110 and is disposed at the second plate edge 114 of mounting plate 110. That is, positioned to face a corresponding edge of the associated winding achage.

In operation, in response to bending of the spider arm, such as may develop during operation of the air core reactor, filament roving 130 that surrounds the ramped surface 118 develops a hoop tension effective to restrain the bending of spider arm 102. For example, since the ramped surface 118 defines an increasing radius relative to central axis from plate location 120 to second plate edge 114, a force that—due to such bending—may develop along a direction schematically represented by arrow 172 (FIG. 2) would increase the hoop tension in filament roving 130.

Therefore, disclosed embodiments make use of the hoop tensile properties of the filament roving to restrain deformations (e.g., bending) that can occur about any of the axes of the spider arm during operation of the air core reactor, such as may occur during a short circuit event, a seismic event, extreme environmental temperatures, etc. That is, disclosed embodiments, improve the bending strength of mounting arrangements in air core reactors.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. An air core reactor comprising:

a winding package positioned to extend along a central axis from a first reactor end to a second reactor end that is opposite the first reactor end;

a spider arm that extends in a direction radially away from the central axis to a spider end, the spider arm located at the first reactor end and coupled to the winding package;

a mounting plate coupled to the spider arm, the mounting plate having a height that extends between a first plate edge and a second plate edge, the mounting plate including an outward plate portion having a ramped surface that extends along a width of the mounting plate from a plate location between the first plate edge and the second plate edge to the second plate edge, the ramped surface defining an oblique angle relative to a plane orthogonal to the height and the width of the mounting plate; and a filament roving wound 360 degrees about the central axis to provide circumferential support to the winding package, the ramped surface of the support plate surrounded by the filament roving.

2. The air core reactor of claim 1, wherein the ramped surface is formed by a plurality of inclined surfaces between the plate location and the second plate edge.

3. The air core reactor of claim 1, wherein the filament roving is formed from a resin-impregnated fiber material.

4. The air core reactor of claim 3, wherein the fiber material has at least one type of fiber selected from the group consisting of glass fibers, basalt fibers, aramid fibers and polyester fibers.

5. The air core reactor of claim 1, wherein the ramped surface defines an increasing radius relative to the central axis from the plate location to the second plate edge.

6. The air core reactor of claim 1, wherein the spider arm includes a planar portion having a height that extends parallel to the central axis to define a first spider arm edge and a second spider arm edge, and a width that extends in a direction normal to the central axis to define an edge width of the spider arm.

7. The air core reactor of claim 6, wherein the mounting plate has a slot that extends from the first plate edge to define a slot length sized to receive the height of the planar portion of the spider arm and having a width sized to receive the width of the planar portion of the spider arm.

8. The air core reactor of claim 7, further comprising a first weld joint extending along the slot to affix the mounting plate to the spider arm at a slot interface.

9. The air core reactor of claim 6, further comprising a support stand having a planar surface arranged to support the edge width of the mounting plate at the first plate edge and the first spider arm edge.

10. The air core reactor of claim 9, further comprising a second weld joint extending along the edge width of the mounting plate to affix the first plate edge to the support stand.

11. The air core reactor of claim 10, further comprising a third weld joint extending along the first spider arm edge to affix the first spider arm edge to the support stand.

12. The air core reactor of claim 11, wherein the first weld joint, the second weld joint, and the third weld joint intersect at a common joining point of the first plate edge, the first spider arm edge and the planar surface of the support stand.

13. The air core reactor of claim 1, comprising a further mounting plate and a further filament roving coupled to a spider arm located at the second reactor end.

14. The air core reactor of claim 1, wherein the winding package is a cylindrical winding package.

15. The air core reactor of claim 1, wherein the height of the mounting plate extends parallel to the central axis and the width of the mounting plate extends in a direction normal to the central axis.

16. The air core reactor of claim 1, further comprising a dielectric strip that extends along the width of the mounting plate and disposed at the second plate edge of the mounting plate.

17. The air core reactor of claim 1, wherein in response to bending of the spider arm that develops during operation of the air core reactor, the filament roving that surrounds the ramped surface develops a hoop tension effective to restrain the bending of the spider arm.

18. A method of operating an air core reactor having a winding package positioned to extend along a central axis from a first reactor end to a second reactor end, and a spider arm that extends in a direction radially away from the central axis to a spider end, the method comprising:

coupling a mounting plate to the spider arm, the mounting plate having a height that extends between a first plate edge and a second plate edge, the mounting plate including an outward plate portion having a ramped surface that extends along a width of the mounting plate from a plate location between the first plate edge and the second plate edge to the second plate edge, the ramped surface defining an oblique angle relative to a surface orthogonal to the height and the width of the mounting plate;

winding a filament roving over 360 degrees about the central axis to provide circumferential support to the cylindrical winding package;

surrounding the ramped surface of the mounting plate with the filament roving; and in response to bending of the spider arm that develops during operation of the air core reactor, the filament roving that surrounds the ramped surface developing a hoop tension effective to restrain the bending of the spider arm.

19. The method of claim 18, further comprising forming the ramped surface by way of a plurality of inclined surfaces between the plate location and the second plate edge.

20. The method of claim 18, wherein the ramped surface defines an increasing radius relative to the central axis from the plate location to the second plate edge.

21. The method of claim 18, wherein the spider arm includes a planar portion having a height that extends parallel to the central axis to define a first spider arm edge and a second spider arm edge, and a width that extends in a direction normal to the central axis to define an edge width of the spider arm, and wherein the method further comprises forming in the mounting plate a slot that extends from the first plate edge to define a slot length sized to receive the height of the planar portion of the spider arm and having a slot width sized to receive the width of the planar portion of the spider arm.

* * * * *